US005647486A

United States Patent [19]

Wilen

[11] Patent Number: 5,647,486

[45] Date of Patent: Jul. 15, 1997

[54] REMOTE PORTABLE ENTERTAINMENT CONTROL AND INFORMATION CENTER

[76] Inventor: Richard Wilen, 135 Oval Dr., Islandia, N.Y. 11722

[21] Appl. No.: 512,154

[22] Filed: Aug. 7, 1995

[51] Int. Cl.[6] ..... B42F 17/00

[52] U.S. Cl. ..... 211/26.1; 248/146; 211/42

[58] Field of Search ..... 211/13, 42, 88, 211/89; 298/309.1; 281/15.1, 21.1, 29

[56] References Cited

U.S. PATENT DOCUMENTS

| | | | |
|---|---|---|---|
| 3,343,776 | 9/1967 | Wieszeck | 248/441 |
| 3,553,864 | 1/1971 | Karlyn et al. | 40/10 |
| 3,914,888 | 10/1975 | Garrison | 40/10 R |
| 4,176,743 | 12/1979 | Fitzpatrick | 211/13 X |
| 4,472,843 | 9/1984 | Chermak | 211/42 X |
| 4,504,235 | 3/1985 | Jones et al. | 434/219 |
| 4,660,792 | 4/1987 | Rogalski | 248/174 |
| 4,706,121 | 11/1987 | Young | 358/142 |
| 4,712,693 | 12/1987 | Striplin | 211/13 X |
| 4,824,059 | 4/1989 | Butler | 248/309.1 X |
| 4,850,124 | 7/1989 | Wilen | 40/122 |
| 4,856,658 | 8/1989 | Novak | 211/13 |
| 4,893,222 | 1/1990 | Mintzer | 211/13 X |
| 4,941,576 | 7/1990 | Sugarman et al. | 211/13 |
| 4,991,817 | 2/1991 | VonKleist et al. | 248/676 |
| 4,991,892 | 2/1991 | Burrell | 294/1.1 |
| 5,031,046 | 7/1991 | Bruggemann | 358/194.1 |
| 5,178,414 | 1/1993 | Small et al. | 281/15.1 X |
| 5,214,422 | 5/1993 | Cullimore | 211/13 X |
| 5,232,247 | 8/1993 | Shields | 281/15.1 X |
| 5,253,066 | 10/1993 | Vogel | 358/188 |
| 5,269,484 | 12/1993 | Jones | 211/13 X |
| 5,285,952 | 2/1994 | Ho | 281/45 X |
| 5,305,980 | 4/1994 | LeBlanc | 248/309.1 |
| 5,316,249 | 5/1994 | Anderson | 211/13 X |
| 5,337,906 | 8/1994 | Digiulio | 211/88 |
| 5,341,941 | 8/1994 | Marlor | 211/88 X |
| 5,348,347 | 9/1994 | Shink | 281/15.1 X |
| 5,353,121 | 10/1994 | Young et al. | 348/563 |
| 5,370,238 | 12/1994 | Czajkowski et al. | 211/13 |
| 5,370,241 | 12/1994 | Silvers | 211/13 |

*Primary Examiner*—Leslie A. Braun
*Assistant Examiner*—Sandra Snapp
*Attorney, Agent, or Firm*—Stephen E. Feldman

[57] ABSTRACT

A portable organizer for information on and equipment for a home entertainment center including a portable substrate defining the foundation of the organizer. A clamping strip is attached to the substrate for receiving the spine of a magazine or booklet with entertainment programming information and for securing the magazine or booklet to the organizer. A transparent, flexible sheet is also attached to the organizer and is used for separating pages of the magazine to make information in the magazine readily available. A remote control device for a TV sat, a VCR set and/or audio equipment is also attached to the substrate, along with a clock or watch.

8 Claims, 3 Drawing Sheets

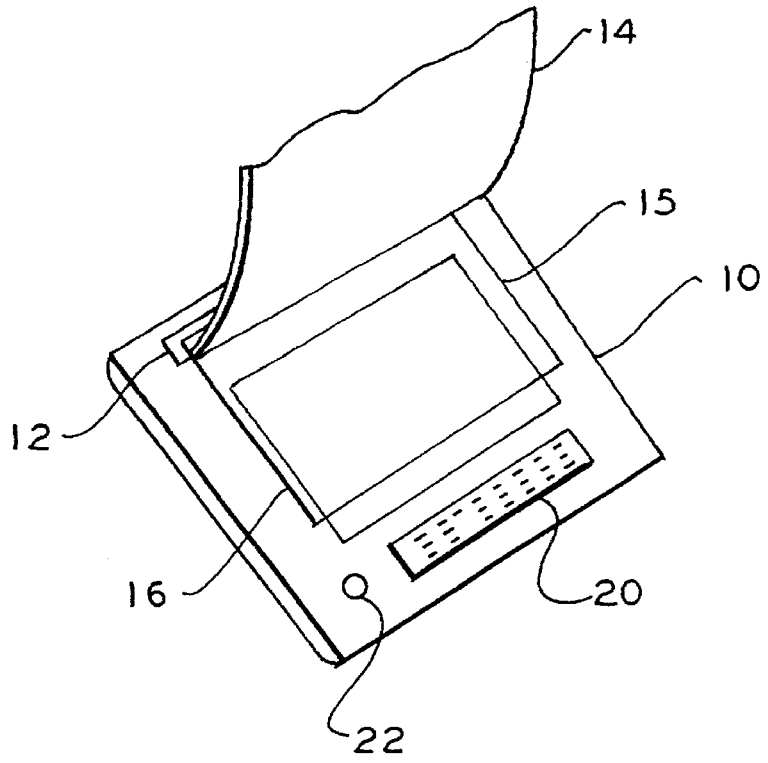
FIG. 6
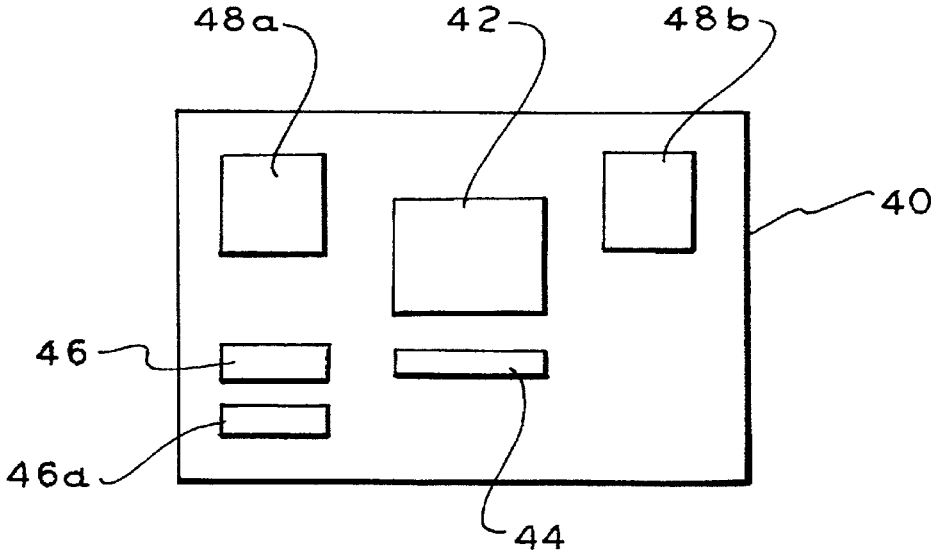

REMOTE PORTABLE ENTERTAINMENT CONTROL AND INFORMATION CENTER

BACKGROUND OF THE INVENTION

1. Field of the Invention

The present invention relates to remote organizers for retaining control of entertainment devices and for effecting the consolidation of entertainment information.

2. Prior Art

Remote control devices for entertainment equipment, such as TV, VCR and audio sets and apparatus, are well established in the households of America. The U.S. patent to Bruggemann, in 1991 teaches one type of remote control device for a TV set or appliance, however, there are presently on the market integrated remote controls units with which one can control a TV set and a VCR set and audio equipment of several different kind. These integrated control devices are available for purchase, over the counter in most electronic and electrical appliance stores.

Other patents issued by the United States of America teach holders for such remote control devices. Examples of such patents are:

U.S. Pat. No. 4,856,658 to Novak issued in 1989;

U.S. Pat. No. 4,991,892 to Burrell issued in 1991;

U.S. Pat. No. 5,269,484 to Jones issued in 1993.

These U.S. patent each teach various apparatus for holding one or more remote control devices for TV set, player/recorders and/or audio components used in the home, often in the entertainment centers of the home. However, in each teaching the holder taught is limited to a device for holding the remote control device itself.

Remote control of TV set, for example, is convenient because of the large number of channels now available on most TV sets. A remote control device saves one from getting up each time one wishes to change a channel. However, the question may very well be asked, what good is the ability to change some 100 or more channels on a TV set without some knowledge of the programming, at the time, on the channels of the TV set.

The prior art has taught assembling and/or holding remote entertainment control devices and entertainment programming information on an individual basis, rather than teaching consolidation of the control devices and entertainment information in a remote, portable center or organizer.

SUMMARY OF THE INVENTION

The present invention provides for combining a remote entertainment control device, for example, a TV control device, and entertainment information, for example, TV program information, in a portable organizer serving as an entertainment control and information center or station. The present invention provides a device or organizer apparatus by which, for example, a TV control device and TV program information may be consolidated in the same, portable unit, which may be remote from the TV set, whereby the TV set may be changed from channel to channel by a TV control device secured to or available on the organizer where program information is available, secured to the same organizer unit, so that TV channel changes may be accomplished with predetermined intent, using a single organizer.

Preferably, the present invention provides an organizer or control station provided with a magazine or booklet retaining strip for securing a TV program booklet, for example, to the organizer. A transparent page retainer sheet is coupled along one edge of the organizer so that the transparent sheet may be made to cover or be laid over a page of the booklet retained in the retaining strip so as to effectively separate such page from the remaining pages of the magazine secured to the organizer, for quick and easy reference by the user. Also secured to the organizer is a remote control means for controlling a TV, VCR and/or audio system. The remote control unit is conveniently stored or retained in or on the organizer. In addition, a clock or watch is secured to the surface of the organizer for convenient reference to the time. The invention is portable and provides a portable, remote, organized control and information center or station for an entertainment center in the home.

OBJECTS OF THE INVENTION

It is an object of the invention to provide a portable, remote organizer retaining and providing information on entertainment, such as TV and/or audio receiving and recording, and a control means for controlling the entertainment equipment.

This and other objects will become apparent when reading the following detailed disclosure, of a preferred embodiment of the invention and suggested alternate construction, with reference to the drawings.

BRIEF DESCRIPTION OF THE DRAWINGS

FIG. 6 is a representation of the invention and an entertainment center.

DETAILED DESCRIPTION OF THE INVENTION

Figure 1:
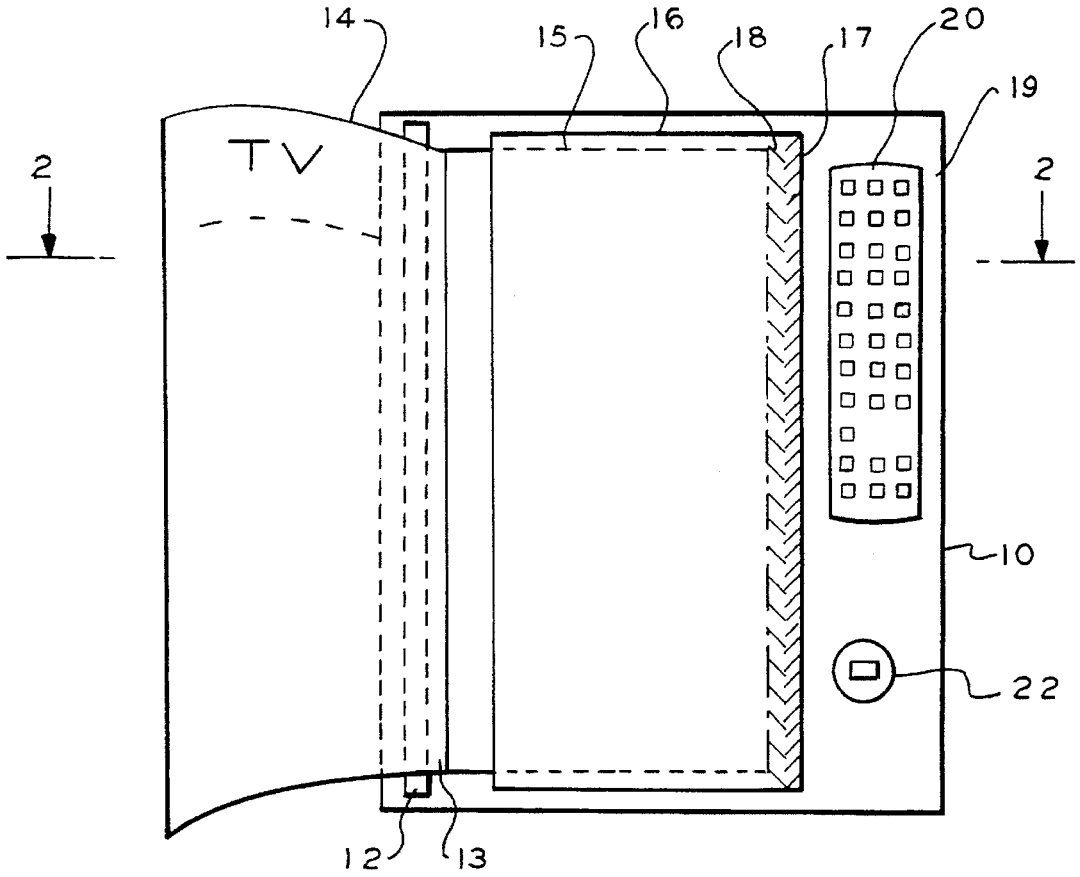
FIG. 1 is a representation of the invention in plan, pictorial view.

Referring to the various Figures, identical elements of the invention, which are shown throughout the drawings, are identified by identical call-out numbers.

Referring to FIGS. 1, 2, 3 and 4, the upper surface or face of the organizer 10 has mounted thereon, a clamping strip 12, which is secured to the face or upper surface, along an edge thereof. The clamping strip 12 is adapted to receive and secure the fold or spine, 13, of a magazine or booklet 14, thus holding or retaining the magazine 14 on the upper surface or face of the organizer. Offset laterally from the clamping strip and secured substantially in parallel with and on the upper surface, is a flexible, transparent sheet of material 16, which is preferably a sheet of transparent, flexible, plastic material. The sheet 16 is preferably rectangular in shape and is secured to the face of the organizer, along one of the edges of the sheet, by a sheet securing strip 17, for example. The sheet 16 may be in another geometric configuration, if desired.

Preferably, the size and length of the clamping strip 12 is such that the spine 13 of a TV program magazine or booklet 14 may be inserted into the clamp and be secured by the clamp, thus retaining or securing the inserted magazine or booklet to the face or upper surface of the organizer. The size of the sheet 16 is preferably sufficiently large to cover a substantial surface of a page of a magazine retained in the clamping strip.

Preferably, the spacing between the clamping strip 12, secured to the face of the organizer, and the securing 17 securing the edge of the flexible sheet 16 to the face of the organizer, is such that the sheet 16 may be laid flat upon the upper surface of the organizer, between the clamping strip 12 and the sheet securing strip 17, if desired. Preferably, only one edge of the sheet 16 is secured to the upper surface of the organizer, although adjacent edges of the sheet may be secured to the upper surface of the organizer, if desired.

The size of the sheet 16 and the spacing between the clamping strip 12 and the sheet securing strip is such so that when a magazine or booklet is secured in the clamping strip and the magazine or booklet is held on the upper surface of the organizer, one or more pages of the magazine or booklet may be laid on the upper surface of the organizer and an exposed sheet of a laid out page may be covered by the flexible, transparent sheet, making the exposed sheet quickly selectable from the uncovered pages of the magazine or booklet.

Attention is directed to FIG. 1 which shows a preferred embodiment of the invention in use, where a TV Program booklet or magazine 14 is secured, by its spine 13 in the clamping strip 12. One or more pages 15 are laid out on the surface of the organizer 10 and the flexible, transparent sheet 16 is placed over an exposed surface of a page so that the secured magazine is easily and quickly opened to the exposed page covered by the sheet 16, by the user of the invention.

Figure 4:
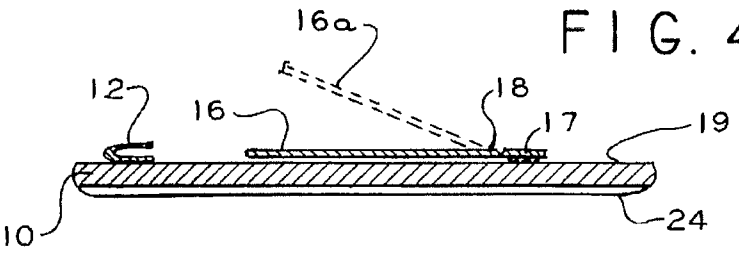
FIG. 4 is a cross section view along line 4—4 of FIG. 3.
Figure 3:
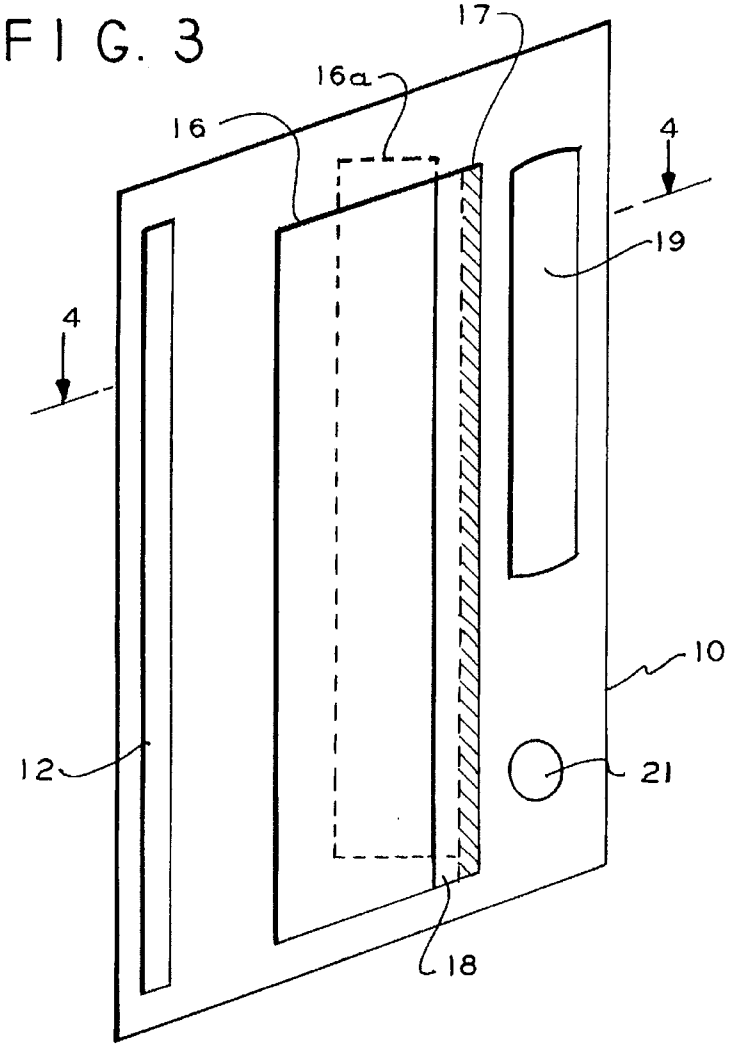
FIG. 3 is a representation of the invention in perspective, pictorial view.

As shown in FIGS. 3 and 4, the sheet 16, which is secured to the upper surface of the organizer along one edge thereof, may be lifted off the surface of the organizer, as represented by the sheet 16*a* represented in broken line form, so that one or more pages of a magazine or booklet secured in the clamping strip may be easily and conveniently placed on the upper surface of the organizer and be covered by the flexible, transparent sheet, easily, quickly and conveniently. This effectively separates the covered, exposed surface of the page from the other pages of the magazine or booklet, making the exposed sheet directly under the flexible, transparent sheet, indexable and conveniently viewable, when desired.

Adjacent and parallel with the sheet securing strip 17, is a retaining means 19 for a remote control device 20. The remote control device 20 may be a remote TV controller or a remote VCR controller or a remote audio component controller, or, may be a unitary remote control device that is capable of controlling any one or all of the entertainment appliances. Individual remote controllers are normally provided with an appliance adapted for remote control, when the appliance is purchased. An integrated remote controller, which can control all type of entertainment appliances, is available for purchase over the counter in most electrical appliance stores and outlets.

Figure 2:
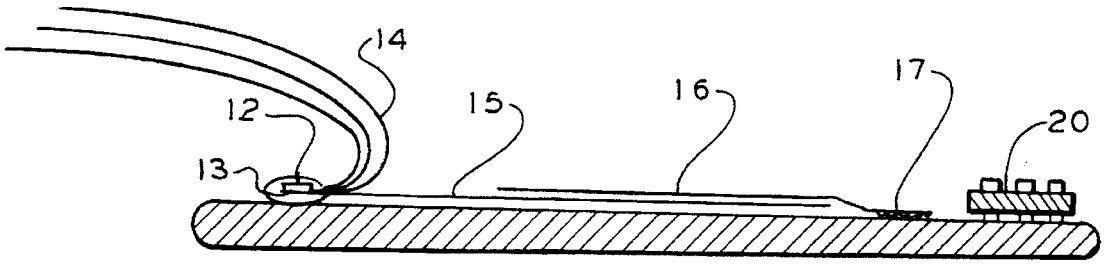
FIG. 2 is a cross section view along line 2—2 of FIG. 1.
Figure 4A:
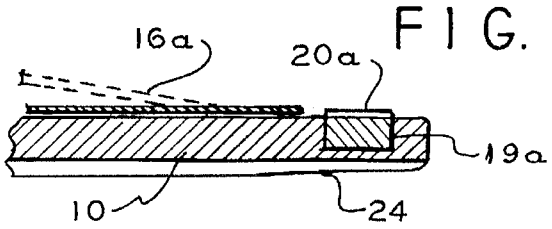
FIG. 4*a* is a cross section view along line 4—4 of FIG. 3, showing an alternate construction of a portion of the invention.

A remote control device, such as 20, may be secured to the upper surface of the organizer such as represented in FIG. 2, or may be recessed in a slot or cavity, as represented in FIG. 4, or may be integrated, by embedding or encapsulating the control device into the body of the organizer, as represented in FIG. 4*a*. Preferably, the remote control device is secured to the surface of the organizer by a retaining means which may be in the form of an adhesive strip or held on to the organizer by a VELCRO retaining system, as represented in FIG. 2. This makes the remote control device easily replaceable. Where integration of the remote control device is desired, whether by embedding the device into the surface of the organizer or by encapsulation of the control device within the body of the organizer, the button surface of the control device may be made substantially flush with the upper surface of the organizer.

The sheet 16 may include a strip 18 on which a user may write data. The write-on strip 18 may be a strip on the sheet 16, on which one may write, or may be a removable strip or tape, such as MAGIC MENDING tape, for example, that may be removably secured to the sheet 16 so as to form a write-on strip.

Preferably, a second retaining means 21 is provided, adapted to receive and retain a clock or watch 22.

A pouch or pocket 24 is also provided on the underside of the organizer 10.

Figure 5:
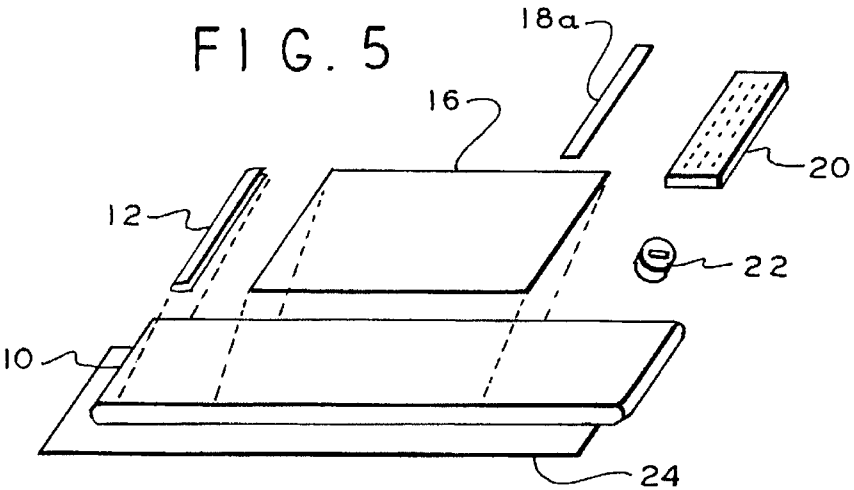
FIG. 5 is an exploded view of the invention.

FIG. 5 is an exploded view of the invention showing the relationship of the elements which form the invention.

FIG. 6 represents the invention in use with a home entertainment system, in which the organizer 10, the flexible, transparent sheet 16, the clamping strip means 12 and the magazine 14 are represented along with the remote control device 20 and clock 22.

A cabinet or entertainment center 40 is represented with a TV set 42 and a VCR 44. An audio component, such as a radio and/or audio preamplifier 46 is represented with a tape or CD player 46*a* and stereo speakers 48*a* and 48*b*.

The remote control device 20 controls the on/off and interconnections of the several entertainment devices, as well as channel and volume change of the TV set 42 by pressing designated buttons on the face of the remote control device.

It will be appreciated that the organizer 10 includes the substrate or base 10 to which is coupled the clamping strip means 12, the flexible, transparent sheet 16, the remote control device 20 and the clock 22. The clamping strip means 12 is preferably in the form of an elongated strip clamp that receives and clasps the back or spine of a magazine or booklet, for example, however, the clamping strip means may be in the form of two or more short clamps spaced along the of the organizer 10. Alternatively, the clamping strip means may be in the form of fasteners, rings or wire bridle, for example, or any other means that may be used to secure the spine of the magazine or booklet in place, on the substrate.

The clamping strip means 12 holds the magazine 14, which is assumed to have printed, on its pages, TV program information. One of the pages 15 of the magazine 14 is laid out on the upper surface of the substrate and the flexible, transparent sheet 16 covers the page so that the page is effectively separated from the other pages of the magazine. It will be appreciated that by separating the page 15 by the transparent sheet 16 the page 15 is immediately recoverable. It will be further appreciated that the organizer is both portable and remote from the home entertainment center but the user of the organizer has control over equipment in the home entertainment center, as defined above.

Thus, a preferred embodiment of the invention, a portable, remote entertainment control and information center or station has been disclosed in the form of an organizer. Alternate structure is shown and suggested. Other changes and modification may be made, as will become apparent to those skilled in the art, without departing from the invention.

What is claimed is:

1. An organizer for retaining program information and a remote control means for controlling entertainment equipment in a home environment, said organizer comprising:

a portable substrate having a substantially rectangular configuration with an upper surface and a lower surface defining a one-piece base for said organizer;

a clamping strip means coupled to said upper surface along one edge thereof, for receiving a spine of a multi-page magazine, for securing said multi-page magazine to said upper surface of said portable substrate;

a transparent, flexible sheet means having a generally rectangular configuration, coupled to said upper surface of said organizer substantially along a second edge of said upper surface for covering at least a page of said multi-page magazine for effectively separating said page from other pages of said multi-page magazine; and a remote control means for controlling an entertainment equipment means in said home environment, said remote control means coupled to said upper surface of said portable substrate along said second edge thereof.

2. An organizer as in claim 1 and further including a clock means coupled to said upper surface of said organizer adjacent said remote control means.

3. An organizer as in claim 1 and further including a write-on strip means on said transparent, flexible sheet means for writing data on said transparent, flexible sheet means.

4. An organizer as in claim 3 and in which said write-on strip means is a removable strip with an adhesive back and a write-on front.

5. An organizer as in claim 1 and further including a second sheet means coupled to said lower surface of said portable substrate defining a pocket on said organizer.

6. An organizer as in claim 1 and in which said remote control means is a remote control device for controlling a television set means.

7. An organizer as in claim 1 and in which said remote control means is a remote control device for controlling a video recorder/player set means.

8. An organizer as in claim 1 and in which said remote control means is a remote control device for controlling an audio means.

* * * * *